United States Patent [19]

Berg

[11] 4,176,652

[45] Dec. 4, 1979

[54] FREE STANDING FIREPLACE

[75] Inventor: Verland V. Berg, 393 Silver City Dr., Boise, Id. 83704

[73] Assignees: Verland V. Berg, Boise; Raymond Tracy, Cascade, both of Id.

[21] Appl. No.: 825,969

[22] Filed: Aug. 19, 1977

[51] Int. Cl.[2] ..... F24B 7/00

[52] U.S. Cl. ..... 126/121; 126/120

[58] Field of Search ..... 110/205, 213, 214, 244, 110/322, 326; 126/99 C, 106, 110 C, 112, 118, 120, 121, 144, 149, 150, 146, 142, 77, 26, 297, 63, 125, 83

[56] References Cited

U.S. PATENT DOCUMENTS

| | | | |
|---|---|---|---|
| 3,359,964 | 12/1967 | Wilson | 110/326 |
| 3,499,432 | 3/1970 | Hannebaum | 126/120 |

FOREIGN PATENT DOCUMENTS

| | | | |
|---|---|---|---|
| 844348 | 8/1960 | Australia | 126/121 |
| 368049 | 6/1921 | Fed. Rep. of Germany | 126/83 |
| 844348 | 8/1960 | United Kingdom | 126/121 |

*Primary Examiner*—William F. O'Dea
*Assistant Examiner*—Henry Bennett
*Attorney, Agent, or Firm*—Paul F. Horton

[57] ABSTRACT

A free standing fireplace having a base, a fire pot mounted on the base, a fire pot housing ring encircling the fire pot, a substantially cylindrical combustion chamber vertically mounted on the ring, and a conical hood mounted on the combustion chamber. The hood has on its interior a substantially horizontally projecting, upwardly spiraling flange for imparting a circular motion to combustion fumes rising through the hood. The fire pot housing ring preferably contains two oppositely disposed air vents having openings facing in opposite directions, so that air drawn into the combustion chamber swirls in a circular motion in the same direction as the upwardly spiraling flange of the hood. A damper may be placed across the base of the hood between opposite portions of the flange for forcing the air into an upward spiraling motion, thereby allowing for greater heat absorbtion by the hood.

3 Claims, 4 Drawing Figures

FREE STANDING FIREPLACE

BACKGROUND OF THE INVENTION

1. Field of the Invention

This invention relates, in general, to free standing fireplaces, and in particular, to free standing fireplaces having an enclosed combustion chamber.

2. Description of the Prior Art

Primarily because of their structural arrangement and because of thier ornamental characteristics, free standing fireplaces have seldom been provided with energy saving devices. The combustion chambers of free standing fireplaces are generally characterized by having large nonclosable openings which result in a noncontrollable draft which draws far more heat from the room than the fireplace provides. Heat conduction is largely limited to the smooth interior walls of the hood.

BRIEF SUMMARY OF THE INVENTION

The present invention comprises, generally, a free standing fireplace having a base, a firepot mounted on the base, a firepot housing ring encircling the firepot, a substantially cylindrical combustion chamber mounted on the housing, and a conical hood mounted on the combustion chamber. The hood contains a substantially horizontally projecting, upwardly spiraling, flange mounted on the interior wall for imparting a slow circualr motion to the combustion fumes. The firepot housing may also contain at least two oppositely disposed air vents having their openings in opposite directions for imparting a circular motion to air to facilitate the operation of the spiral flange of the hood.

It is an object of the present invention to provide a free standing fireplace having a hood with a large heat absorbing area.

More particularly, it is an object of the present invention to porvide a free standing fireplace having a hood which has an interiorly located, heat absorbing, upwardly spiraling, flange.

It is also an object of the present invention to provide a free standing fireplace having an enclosed combustion chamber and controllable air intake vents.

It is a further object of the present invention to provide a free standing fireplace having oppositely disposed air intake vents having their openings in opposite direction for imparting a circular motion to air to facilitate and to work jointly with the spiral flange of the hood.

It is a further object of the present invention to provide a free standing fireplace having an enclosed combustion chamber including tempered glass panels for visually determining maximum operating efficiency.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
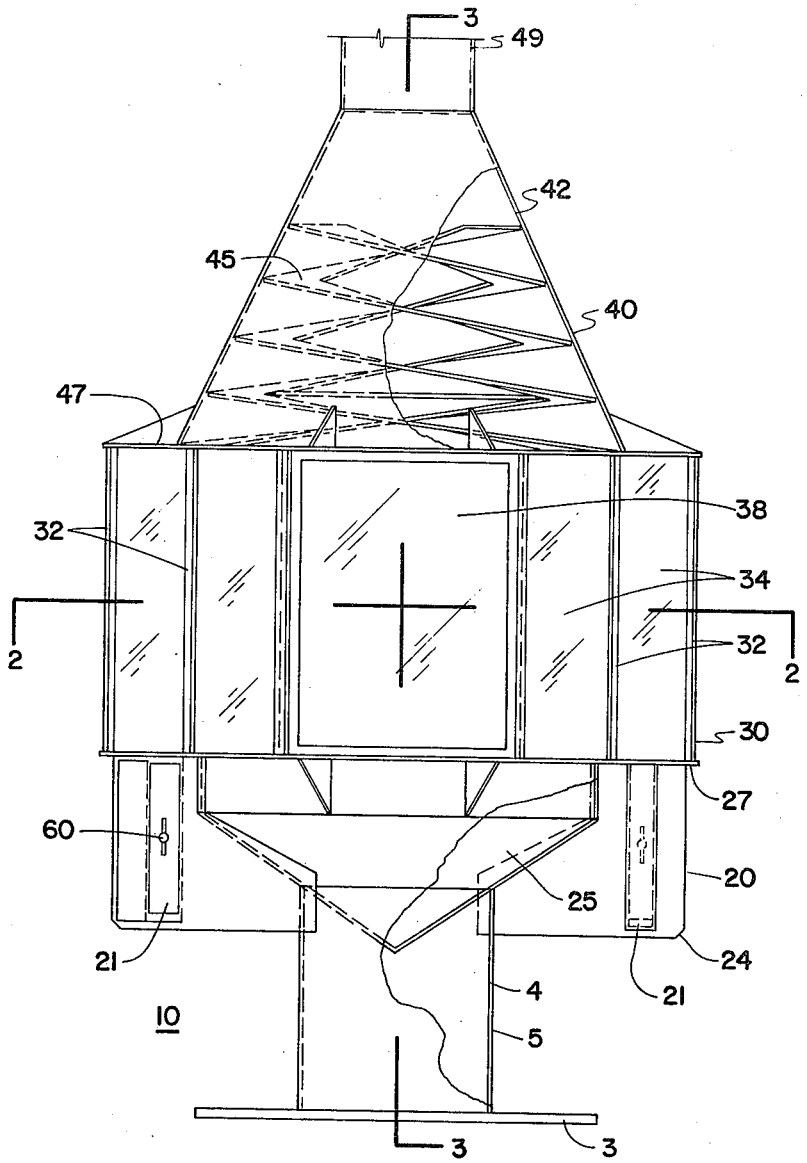
FIG. 1 is a front elevation of a preferred embodiment of the free standing fireplace of the present invention.
Figure 2:
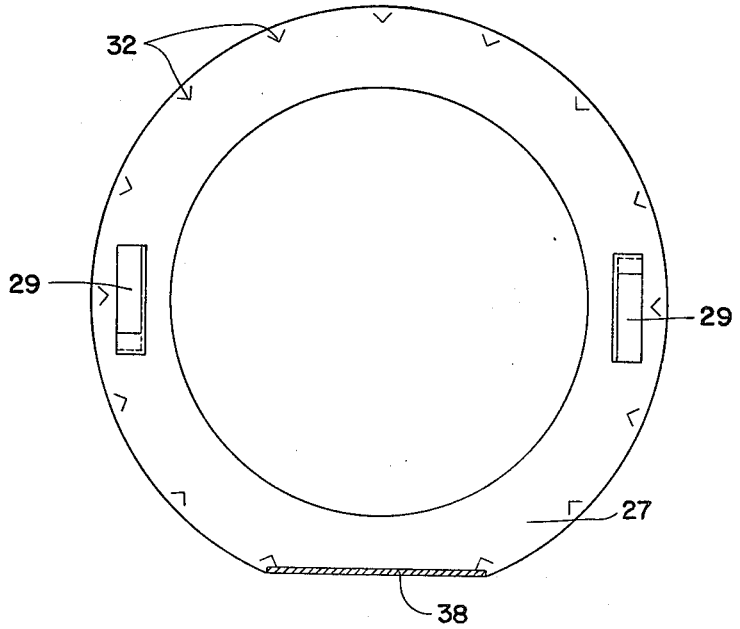
FIG. 2 is a sectional view taken along lines 2—2 of FIG. 1.

Referring now to the drawings, and, more particularly, to FIG. 1, an embodiment to be preferred of a free standing fireplace 10, made according to the present invention is disclosed. Free standing fireplace 10 includes a base 5, a firepot housing ring 27, a firepot 25, a combustion chamber 30, and a conical hood 40.

Base 5 is conventional in nature and preferrably has a cylindrical side wall 4 mounted on a ground plate 3 which may simply rest on the floor or be attached by bolt, screw, or the like.

Firepot 25 is conical in shape having an outer shell structure 24 including a vertical wall 23. In place, the cone shaped firepot has its apex pointed downward and centered within base 5. Shell 24 is filled with a fire proof composition containing preferrably three parts fire clay, one part sand and one part cement. The composition is placed in the shell, filling the shell to the top of side walls 23, and is then smoothed out so that it too is conical in configuration. Firepot 25 is securely mounted to base 5 by welding or otherwise. The preferred composition gives the firepot strength, hardness and keeps the outer part of shell 24 from getting hot, thereby eliminating any fire hazard to close-by objects or the floor.

Figure 3:
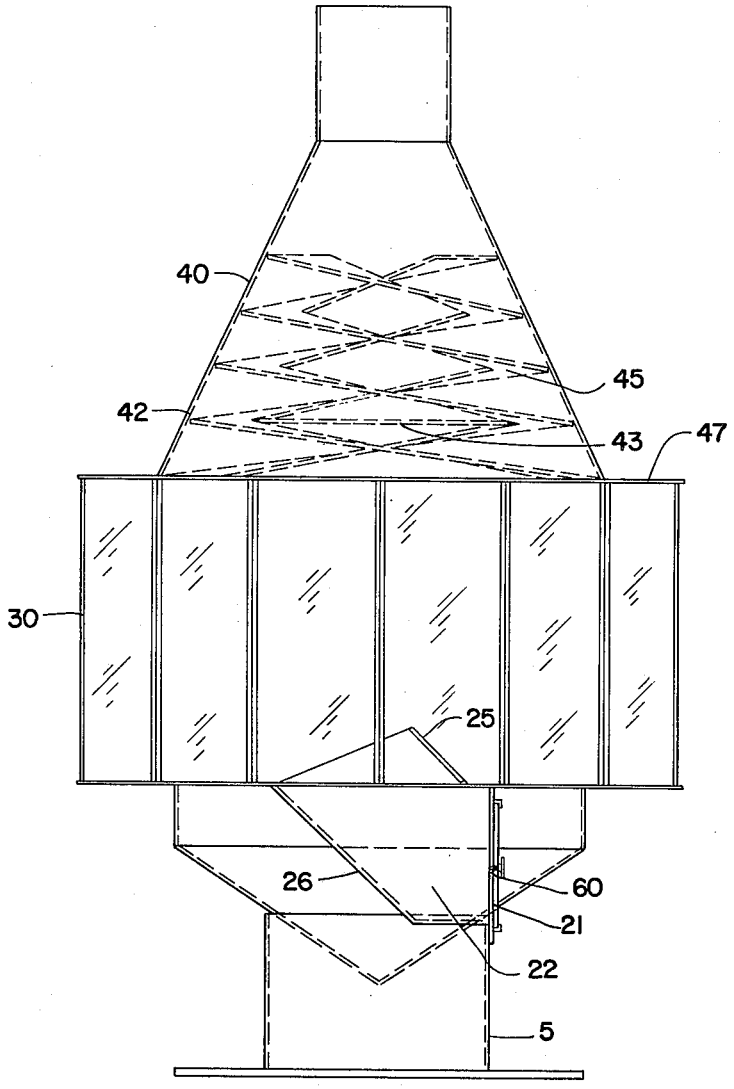
FIG. 3 is a cross sectional view taken along lines 3—3 of FIG. 1.
Figure 4:
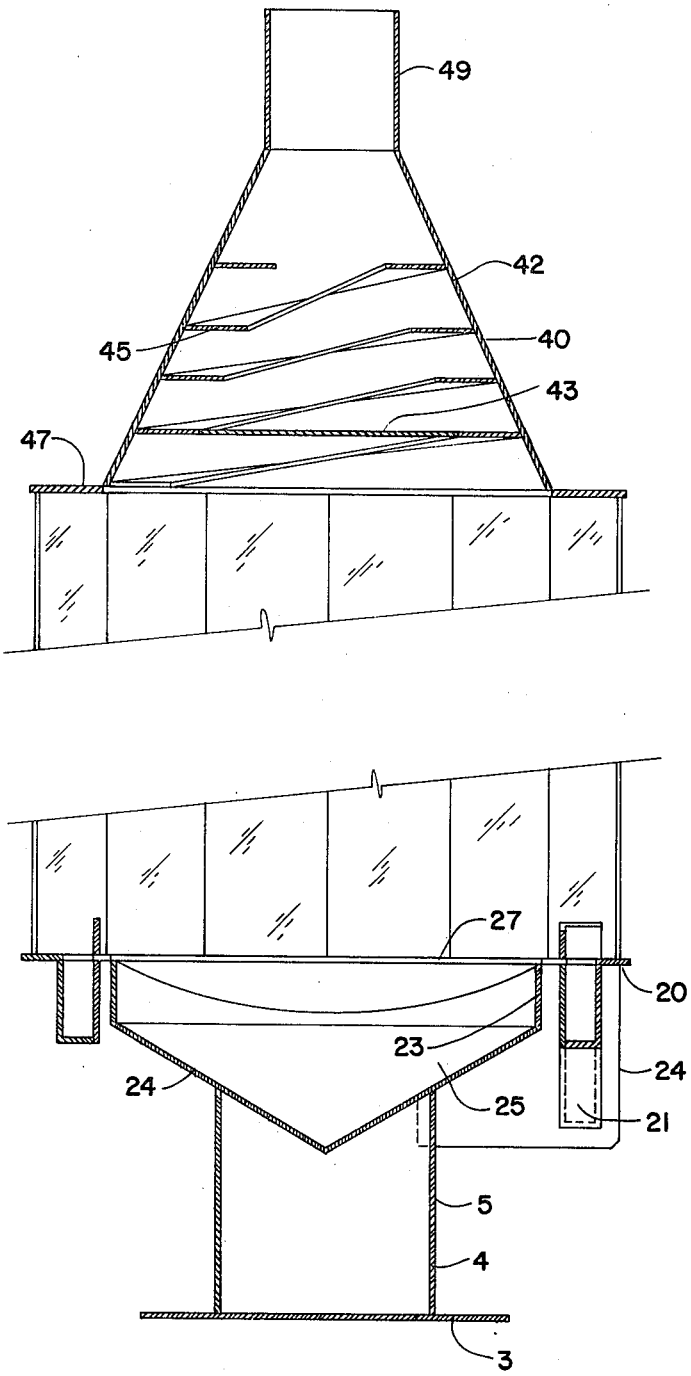
FIG. 4 is a front sectional view of a preferred embodiment of the present invention.

Firepot housing ring 27 is a flat annular ring mounted horizontally flush on the top lip of wall 23 of firepot 25. A downwardly depending member 24 encloses and supports air vents 21. Ring 27 supports combustion chamber 30 as will hereinafter be described and also contains apertures for air vents 21. In the preferred embodiment, fireplace 10 includes oppositely disposed air vents 21 downwardly depending from ring 27, enclosed within member 24. Air vents 21 each include an air passage having a pair of vertically extending side walls 22 an upper wall 25, and a lower wall 26, the upper and lower walls extending transversely to the side walls and parallel one to another at an upward slope at an angle of approximately 45° to horizontal. The walls may terminate at air entrance apertures 29 of ring 27, seen to advantage in FIG. 3. The outermost ends of the air vents may include dampers 60 which permit controlled amounts of air through air vents 21 and which may close the air vents completely.

Combustion chamber 30 may be substantially cylindrical in configuration. The chamber is octagonal in the preferred embodiment containing a plurality of metallic vertical supports 32, each of which encases and holds in place tempered glass panels 34. The entire structure is securely mounted vertically on ring 27. Chamber 30 also includes a tempered glass door 38 which sealingly closes the combustion chamber when closed, and, when open provides entrance to the firepot for the placement of combustible materials and for the removal of ashes.

A second flat horizontal ring 47 is mounted horizontally on and secured to the top most terminal ends of vertical supports 32. Upper ring 47 serves to hold vertical supports 32 in place and also serves as a base support for hood 40. Hood 40, of conventional conical formation, is provided with a flue vent 49 which is centrally mounted adjacent the apex of the cone-shaped hood. Mounted on the interior wall 42 of hood 40 is a horizontally oriented, upwardly spiraling flange 45 extending from substantially the lowermost portion of the hood to the uppermost portion of the hood adjacent flue vent 49. Flange 45 may spiral upward in either a clockwise or counter clockwise direction it only being necessary that it spiral upward in the same direction as the vent opening 21. An annular damper plate 43 may be installed, preferrably adjacent the base of conical hood 40 between opposing portions of the flange.

In operation, combustible material is either piped into the firepot 25 or placed in firepot 25 through door 38 and ignited. Damper control 60 is fully opened to allow maximum flow of air into combustion chamber 30 in communication with firepot 25. With vent openings in the direction shown in FIG. 1 it will be seen that air entering air vents 21 will have an upward and clockwise motion as viewed from the top of the chamber. The air and fumes of combustion still circling in a clockwise motion are pulled upwardly into hood 40 by the draft. Damper plate 43 prevents a purely vertical motion of the air forcing the air to continue its clockwise spiral upward along the bottom most edges of flange 45. In this manner, the upward draft is slowed allowing the extending flange 45 to absorb a large portion of the heat from the heated air and fumes. Flange 45, being metallic and in direct conductive union with hood wall 42, also metallic, allows a large percentage of the heat thus absorbed to be radiated from the exterior of wall 42 of hood 40 into the surrounding air. The smoke and fumes then pass through air vent 49 which is connected to a chimney or other venting device.

Having thus described in detail a preferred embodiment of the present invention, it is to be appreciated and will be apparent to those skilled in the art that many physical changes could be made in the apparatus without altering the inventive concepts and principles embodied therein. The present embodiment is therefore to be considered in all respects as illustrative and not restrictive, the scope of the invention being indicated by the apended claims rather than by the foregoing description, and all changes which come within the meaning and range of equivalency of the claims are therefore to be embraced therein.

I claim:

1. A free standing fireplace comprising:

a base;

a firepot mounted on said base;

a substantially cylindrical combustion chamber mounted on said base and enclosing said firepot, said combustion chamber including a housing ring encircling said firepot, the housing ring having oppositely disposed downwardly depending air vents opening in opposite directions, a plurality of vertically extending, parallel support braces circularly spaced upon the housing ring, a second housing ring horizontally mounted upon the support braces, a plurality of tempered glass panels vertically disposed between the support braces, sealingly engaging the support braces and the first and second housing rings, and a door operable to open and close said chamber; and a conical hood having its base sealingly engaging said chamber, said hood having a flue vent at its apex, and said hood having a substantially horizontally projecting, upwardly spiraling flange mounted to its interior wall for imparting a circular motion to combustion fumes.

2. A free standing fireplace comprising:

a base;

a firepot mounted on said base;

a firepot housing ring encircling the firepot, said ring having at least two oppositely disposed air vents having their openings in opposite directions for imparting a circular motion to air drawn within a combustion chamber;

a substantially cylindrical combustion chamber vertically mounted on said housing ring; and a conical hood mounted on the uppermost vertical end of said chamber, said hood having a flue vent at its apex, and said hood having a substantially horizontally projecting, upwardly spiraling flange mounted interiorly in heat conductive contact with said hood for imparting a circular motion to combustion fumes.

3. A fireplace as set forth in claim 2, wherein each of said vents include an air passage having a pair of vertically extending side walls and parallel upper and lower walls upwardly extending at substantially a 45° angle to horizontal.

* * * * *